US008418790B2

(12) United States Patent
Dauderman et al.

(10) Patent No.: US 8,418,790 B2
(45) Date of Patent: Apr. 16, 2013

(54) COOLING PACKAGE BAFFLE OR DUCTING

(75) Inventors: Bradley Dauderman, Dubuque, IA (US); Erich Vierkant, Dubuque, IA (US)

(73) Assignee: Deere & Company, Moline, IL (US)

( * ) Notice: Subject to any disclaimer, the term of this patent is extended or adjusted under 35 U.S.C. 154(b) by 15 days.

(21) Appl. No.: 13/237,288

(22) Filed: Sep. 20, 2011

(65) Prior Publication Data

US 2013/0068178 A1 Mar. 21, 2013

(51) Int. Cl.
*B60K 11/00* (2006.01)
*B60J 7/00* (2006.01)

(52) U.S. Cl.
USPC ..... 180/68.1; 180/68.2; 296/193.11

(58) Field of Classification Search ..... 180/68.1–68.6, 180/69.21, 69.2; 296/193.11; 123/41.49, 123/41.48
See application file for complete search history.

(56) References Cited

U.S. PATENT DOCUMENTS 4,086,926 A * 5/1978 Green et al. ..... 606/143
4,606,422 A 8/1986 Jewett
4,815,550 A 3/1989 Mather
6,655,486 B2 * 12/2003 Oshikawa et al. ..... 180/68.1
6,662,892 B2 * 12/2003 Falk et al. ..... 180/68.1
6,889,490 B2 5/2005 Hornung
7,370,718 B2 5/2008 Witwer
7,946,367 B2 * 5/2011 Good ..... 180/68.1
2010/0116229 A1 * 5/2010 Kojima ..... 123/41.49

* cited by examiner

*Primary Examiner* — John Walters
*Assistant Examiner* — James Triggs
(74) *Attorney, Agent, or Firm* — D'Hue Law LLC; Cedric A. D'Hue

(57) ABSTRACT

An air flow system is disclosed. The system is for use with a vehicle including an internal combustion engine, a heat exchanger, a cover, and a compartment baffle separating an engine compartment from a cooling compartment. The system includes a side air intake including a side air intake baffle. The side air intake baffle configured to inhibit air heated by the engine from mixing with ambient air used with the heat exchanger. In another embodiment, the system includes a side air duct. The side air duct includes a side air duct, wherein the side air duct tubing is at least partially located within the engine compartment. The side air duct tubing is configured to inhibit air heated by the engine from mixing with ambient air used with the heat exchanger.

17 Claims, 6 Drawing Sheets

COOLING PACKAGE BAFFLE OR DUCTING

FIELD

This disclosure pertains to separate cooling systems for motor vehicles, and more specifically to a side screen air inlet and a passageway for directing ambient cooling air to a radiator and/or oil cooler.

BACKGROUND

Vehicles, such as construction and forestry equipment, typically enclose an engine, cooling system and other vehicle components. Such vehicles commonly utilize liquid cooled internal combustion engines which generate heat during their operation. Liquid-cooled engines employ pressurized coolant circulated through the engine to absorb heat. The heated coolant is subsequently passed through a heat exchanger such as a radiator to dissipate heat from the coolant to the atmosphere, after which the coolant is recirculated to the engine for further engine cooling. As the coolant is passed through the heat exchanger, air flows through the heat exchanger to absorb heat and carry it out into the atmosphere. Air is commonly drawn or propelled through the radiator and/or oil cooler by use of a fan. Vehicles also may include a baffle to prevent the air supply from being heated by the engine as the air is drawn to and passed through the radiator and/or oil cooler.

The capacity of a cooling system in such a vehicle depends on many factors including the velocity and volume of air flowing through the heat exchanger, as well as the distribution of the air flow over the available heat exchange surface of the radiator and/or oil cooler. These vehicles may be used in construction, forestry or other dirty environments with high levels of airborne particulate matter, so the air used to cool the radiator is frequently contaminated with dust, dirt and similar debris. Typically, such vehicles will include grilles or screens over their air intakes to reduce debris present in the cooling air while allowing the air to pass into the area enclosed by the hood to cool the engine by interaction with the radiator and/or oil cooler. However, debris may accumulate on and around the outer surface of the grille or screen, clogging the intake and restricting the air flow. In these vehicles, debris tends to build up rapidly and accumulate first on those areas of a grille or screen where air flows at the highest velocity. Air velocity at some areas of a grille or screen may be substantially higher than the velocity at other areas. Areas of the grille or screen that are relatively close to the air inlet side of the radiator and/or oil cooler may have air flow velocities several times higher than areas further away from the air inlet side of the radiator and/or oil cooler. For example, the air velocity may be as high as 20,000 mm/second at air intake openings near the air inlet side of the radiator and/or oil cooler, and less than 1000 mm/second at air intake openings furthest from the radiator. Areas of the grille or screen that provide air flow to relatively larger areas of the radiator and/or oil cooler may also have air flow velocities several times higher than areas that provide air flow to relatively smaller areas of the radiator and/or oil cooler. For example, the air velocity may be as high as 20,000 mm/second at air intake openings servicing larger sections of the radiator and/or oil cooler, and less than 1000 mm/second at air intake openings servicing smaller sections of the radiator and/or oil cooler.

If enough debris accumulates to block the portion of the grille or screen with the highest air velocity, the effective air intake area is reduced. As a result, the vehicle's engine may not be cooled as efficiently or quietly.

A baffle structure is needed for such a vehicle that provides improved air flow efficiency. A baffle structure is needed that can provide a supply of cooling air to an engine for a construction or forestry vehicle or similar vehicle without the flow being interrupted or compromised due to blockages of the grille or screen caused by dust, dirt or similar debris. A baffle structure on a construction or forestry vehicle or similar vehicle is needed that can provide more uniform and even air flow velocity across different areas of a grille or screen. A baffle structure for a construction or forestry vehicle or similar vehicle is needed that includes an air intake that provides more uniform air flow while minimizing engine noise escaping from the engine compartment.

SUMMARY

In an exemplary embodiment of the present disclosure, an air flow system is disclosed for use with a vehicle including an internal combustion engine, a heat exchanger, and a cover, wherein the cover defines an engine compartment for the engine and a cooling compartment for the heat exchanger, and a baffle separating the engine compartment and the cooling compartment, the baffle separating air heated by the engine from ambient air used with the heat exchanger. The air flow system comprises a fan located in the cooling compartment, the fan configured to draw ambient air over the heat exchanger, a side air intake configured to intake ambient air, the side air intake including a side air intake frame defining a side air intake opening, the side air intake including a screen located within the side air intake opening, the screen configured to inhibit debris from entering the cooling compartment, the side air intake including a side air intake baffle coupled to the side air intake frame, the side air intake baffle configured to inhibit air heated by the engine from mixing with ambient air used with the heat exchanger, the cover defining a side air opening, the side air opening being located along at least one side of the engine compartment, the side air intake frame being located within the side air opening, the side air intake opening and the side air opening in fluid communication with ambient air and the cooling compartment.

In another exemplary embodiment of the present disclosure, an air flow system is disclosed for use with a vehicle including an internal combustion engine, a heat exchanger, a cover, wherein the cover defines an engine compartment for the engine and a cooling compartment for the heat exchanger, and a compartment baffle separating the engine compartment and the cooling compartment, the compartment baffle separating air heated by the engine from ambient air used with the heat exchanger. The air flow system comprises a fan located in the cooling compartment, the fan configured to draw ambient air over the heat exchanger, a side air intake configured to intake ambient air, the side air intake including a side air intake frame defining a side air intake opening, the side air intake including a screen located within the side air intake opening, the screen configured to inhibit debris from entering the cooling compartment, the side air intake including a side air intake baffle coupled to the side air intake frame, the side air intake baffle configured to inhibit air heated by the engine from mixing with ambient air used with the heat exchanger, and the side air intake frame being located within a side air opening defined by the cover, the side air intake opening and the side air opening in fluid communication with ambient air and the cooling compartment.

In yet another exemplary embodiment of the present disclosure, an air flow system is disclosed for use with a vehicle including an internal combustion engine, a heat exchanger, a cover, wherein the cover defines an engine compartment for the engine and a cooling compartment for the heat exchanger, and a compartment baffle separating the engine compartment and the cooling compartment, the compartment baffle separating air heated by the engine from ambient air used with the heat exchanger. The air flow system comprises a fan located in the cooling compartment, the fan configured to draw ambient air over the heat exchanger, at least a portion of the heat exchanger being located lower than the lowest portion of the engine, a side air duct including a side air duct frame, the side air duct frame located within the engine compartment, the side air duct frame defining a side air duct opening, the side air duct including a screen located within the side air duct opening, the screen configured to inhibit debris from entering the cooling compartment, the side air duct including a side air duct tubing coupled to the side air duct frame, the side air duct tubing is at least partially located within the engine compartment, the side air duct tubing configured to inhibit air heated by the engine from mixing with ambient air used with the heat exchanger, and the side air duct being configured to intake ambient air, the side air duct opening and the side air duct tubing in fluid communication with ambient air and the cooling compartment.

BRIEF DESCRIPTION OF THE DRAWINGS

The above-mentioned and other features of this disclosure, and the manner of attaining them, will become more apparent and the disclosure itself will be better understood by reference to the following description of embodiments of the disclosure taken in conjunction with the accompanying drawings, wherein.

Figure 1:
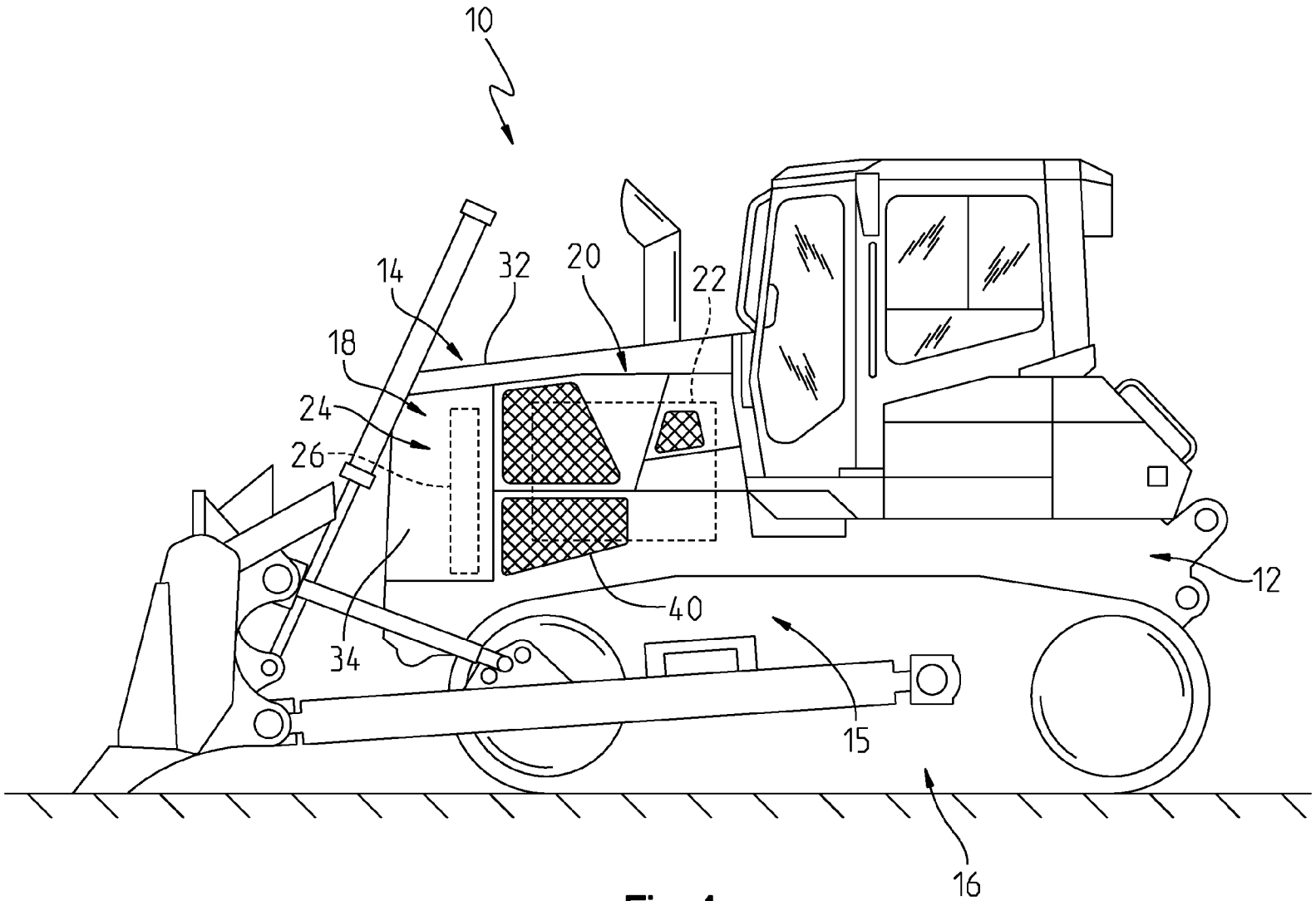
FIG. 1 is a side elevation view of an exemplary vehicle, a crawler dozer, according to an embodiment of the present disclosure.

Corresponding reference characters indicate corresponding parts throughout the several views. Although the drawings represent embodiments of the present disclosure, the drawings are not necessarily to scale and certain features may be exaggerated in order to better illustrate and explain the present disclosure.

DETAILED DESCRIPTION OF THE EXEMPLARY EMBODIMENTS

The embodiments disclosed below are not intended to be exhaustive or limit the disclosure to the precise forms disclosed in the following detailed description. Rather, the embodiments are chosen and described so that others skilled in the art may utilize their teachings.

As illustrated in FIG. 1, vehicle 10, such as construction equipment 10 including crawler dozer 10 is shown. Vehicle 10 includes, among other things, vehicle frame 12, cover 14, floor 15, drive system 16, and cooling system 18 supported by vehicle frame 12. Cover 14 and floor 15 define engine compartment 20 which encloses engine 22, such as an internal combustion engine. Portions of drive system 16 may be included within engine compartment 20. Cover 14 and floor 15 also define cooling compartment 24 which includes multiple components of cooling system 18 such as heat exchangers 26, and fan 28. Cover 14 also provides a location for compartment baffle 30 which separates engine compartment 20 from cooling compartment 24. Compartment baffle 30 is designed to inhibit air heated by engine 22 in engine compartment 20 from heating ambient air used in cooling compartment 24.

Figure 2:
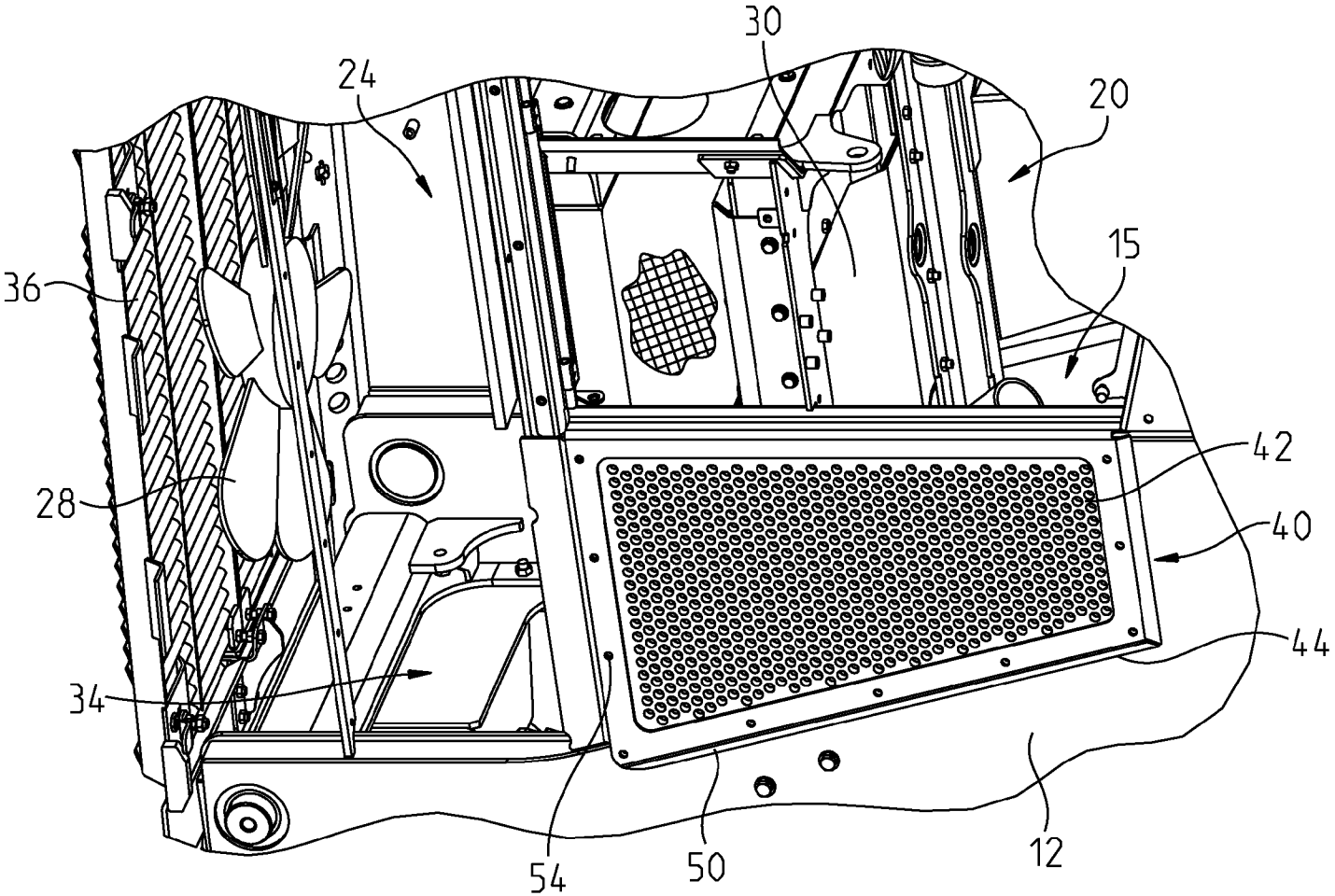
FIG. 2 is a perspective view of engine and cooling compartments according to an embodiment of the present disclosure configured for use with the vehicle of FIG. 1.

As best illustrated in FIGS. 1 and 2, ambient air is drawn into air intakes located on top 32 and sides 34 of cover 14. Ambient air is drawn over heat exchangers 26 by use of fan 28. Fan 28 expels heated ambient air out of grille 36. In this configuration, compartment baffle 30 limits the amount of ambient air available on the side of cooling compartment 24 as opposed to ambient air adjacent (i.e. adjoining or next to) to engine compartment 20. Compartment baffle 30 also limits the amount of ambient air which has not been preheated by engine 22. Furthermore, the amount of ambient air is also limited by the direction of air flow needed to draw ambient air across heat exchangers 26 before expelling heated ambient air out of grille 36.

In addition to maximizing the amount of ambient air provided by top 32 of cover 14, vehicle 10 also includes side air intakes 40 located on cover 14. Some side air intakes 40 are located on cooling compartment 24 side of compartment baffle 30. In this configuration, ambient air is drawn in on cooling compartment 24 side of compartment baffle 30. Compartment baffle 30 inhibits preheating of this ambient air by engine 22.

In some embodiments, there is insufficient space for air intake located on top 32 of cover 14 and side 34 of cover 14 adjacent to cooling compartment 24 side of compartment baffle 30. Insufficient surface area for air intake leads to problems such as excessive air flow velocity. With the use of screens 42 on air intakes, debris can tend to build up rapidly and accumulate on areas of screens 42 where air flow velocity is the highest. If enough debris accumulates to block portions of screen 42 with the highest air flow velocity, effective air intake is reduced. As a result, vehicle 10 may not be cooled as efficiently or quietly.

Figure 3:
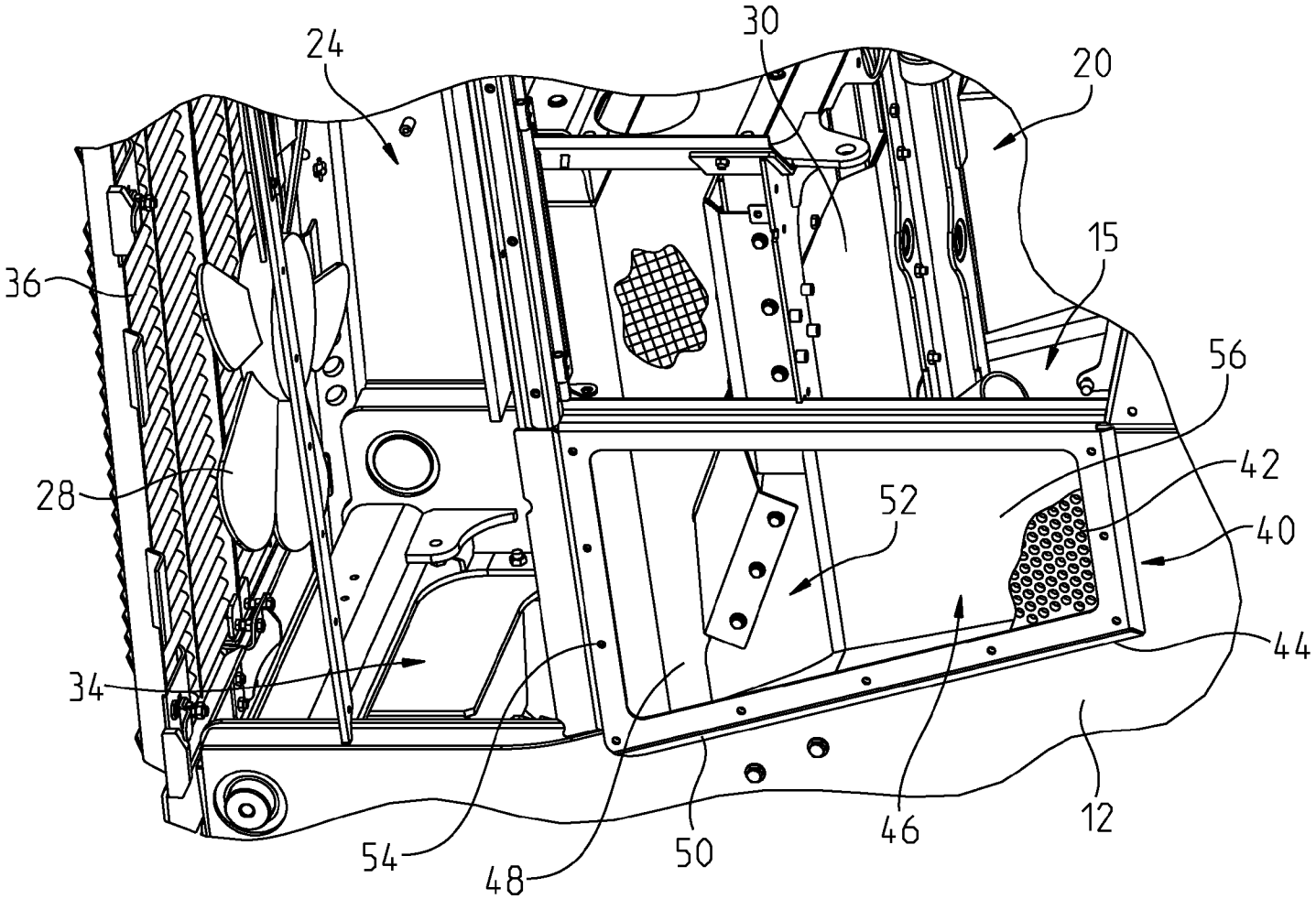
FIG. 3 is another perspective view of the engine and cooling compartments of FIG. 2 with a screen substantially removed.

Side air opening 44 may be at least partially located on at least one side of engine compartment 20 of cover 14. Side air opening 44 may have portions located on both cooling compartment 24 side of cover 14 and engine compartment 20 side of cover 14. As illustrated in FIGS. 2 and 3, side air opening 44 may traverse compartment baffle 30. Compartment baffle 30 may either intersect or bisect side air opening 44.

Side air opening 44 may be located adjacent to, at the same height, or below engine 22. In an exemplary embodiment, at least a portion of side air opening 44 may be located lower than the lowest portion of engine 22. In another exemplary embodiment, the highest point of Side air opening 44 may be located lower than the highest portion of engine 22. In yet another exemplary embodiment, the highest point of Side air opening 44 may be located at or below the mid-point height of engine 22. The location of side air opening 44 assists in providing air flow to the lower portions of heat exchanger 26. The location of side air opening 44 also assists in minimizing the amount of air heated by engine 22 which is inhibited by compartment baffle 30 from mixing with ambient air used in cooling system 18.

As illustrated in FIGS. 2 and 3, side air opening 44 is shown as a polygon. Side air opening 44 may take several shapes. Side air opening 44 may be reduced or stepped down in surface area as side air opening 44 progresses from the side closest to heat exchanger 26 to the side furthest from heat exchanger 26. Engine compartment portions 46 of side air opening 44 further from heat exchanger 26 have at least one dimension that is smaller than cooler compartment portions 48 of side air opening 44 closer to heat exchanger 26.

The largest surface area of side air opening 44 may be located closest to heat exchanger 26 and the smallest surface area of side air opening 44 may be located the furthest from heat exchanger 26. In one exemplary embodiment, cooler compartment portions 48 may have dimensions of approximately 340 millimeters by approximately 535 millimeters and a surface area of approximately $2*10^5$ millimeters$^2$. In one exemplary embodiment, engine compartment portions 46 may have dimensions of approximately 323 millimeters by approximately 310 millimeters and a surface area of approximately $1*10^5$ millimeters$^2$. In this one exemplary embodiment, side air opening 44 increases surface area for ambient air flow by approximately 60%. In this one exemplary embodiment, air flow increases within the range of approximately 15% to approximately 25%.

As best illustrated in FIG. 3, side air intake 40 is shown according to one embodiment of the present disclosure. Side air intake 40 is either partially or completely located on engine compartment 20 side of compartment baffle 30. Side air intake 40 is designed to inhibit air heated by engine 22 located in engine compartment 20 from heating ambient air used in cooling system 18 located in cooling compartment 24. Side air intake 40 is also designed to inhibit air heated by engine 22 located in engine compartment 20 from preheating ambient air used in cooling system 18 locating in cooling compartment 24.

Side air intake 40 includes side air intake frame 50 and side air intake screen 42. Side air intake frame 50 defines side air intake opening 52. Side air intake screen 42 is located within side air intake opening 52. Side air intake opening 52 is in fluid communication with ambient air, side air opening 44, and cooling compartment 24. Side air intake screen 42 is designed to block dust, dirt, or similar debris from entering cooling compartment 24 and cooling system 18. Side air intake screen 42 is also configured to allow ambient air to pass into cooling compartment 24 and cooling system 18.

Side air intake frame 50 is configured to fit within side air opening 44 as defined by cover 14 and vehicle frame 12. Side air intake frame 50 is also configured to couple to cover 14 by use of any suitable form of fasteners 54.

Figure 4:
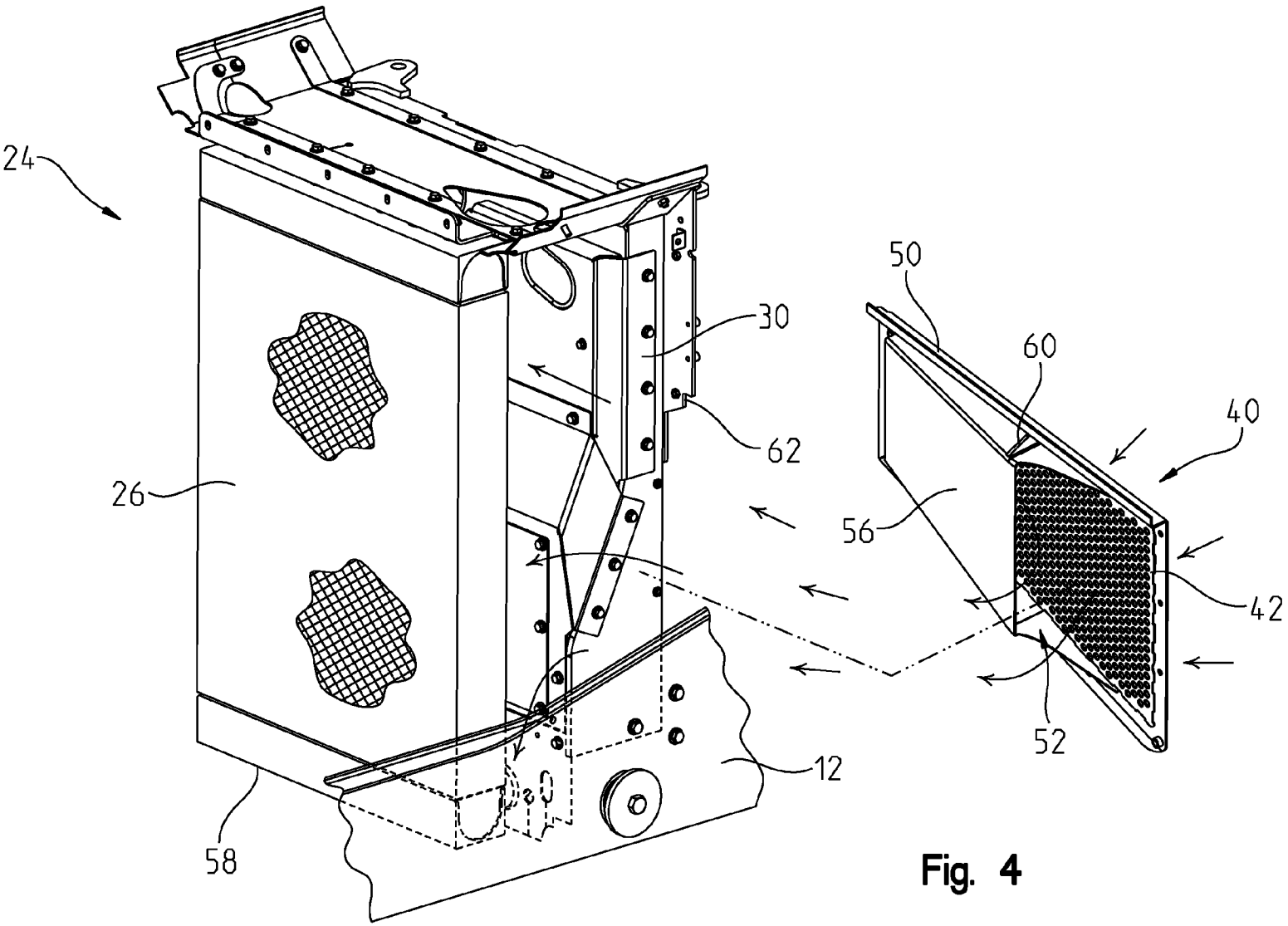
FIG. 4 is an exploded view of parts of the cooling compartment of FIG. 2 which simulates air flow according to an embodiment of the present disclosure.

As previously mentioned, side air intake 40 also includes side air intake baffle 56. As illustrated in FIGS. 2-4, side air intake baffle 56 is an integral component of side air intake 40. It is envisioned that side air intake baffle 56 may be an additional component of side air intake 40. It is also envisioned that side air intake baffle 56 may be an extension of compartment baffle 30.

Figure 5:
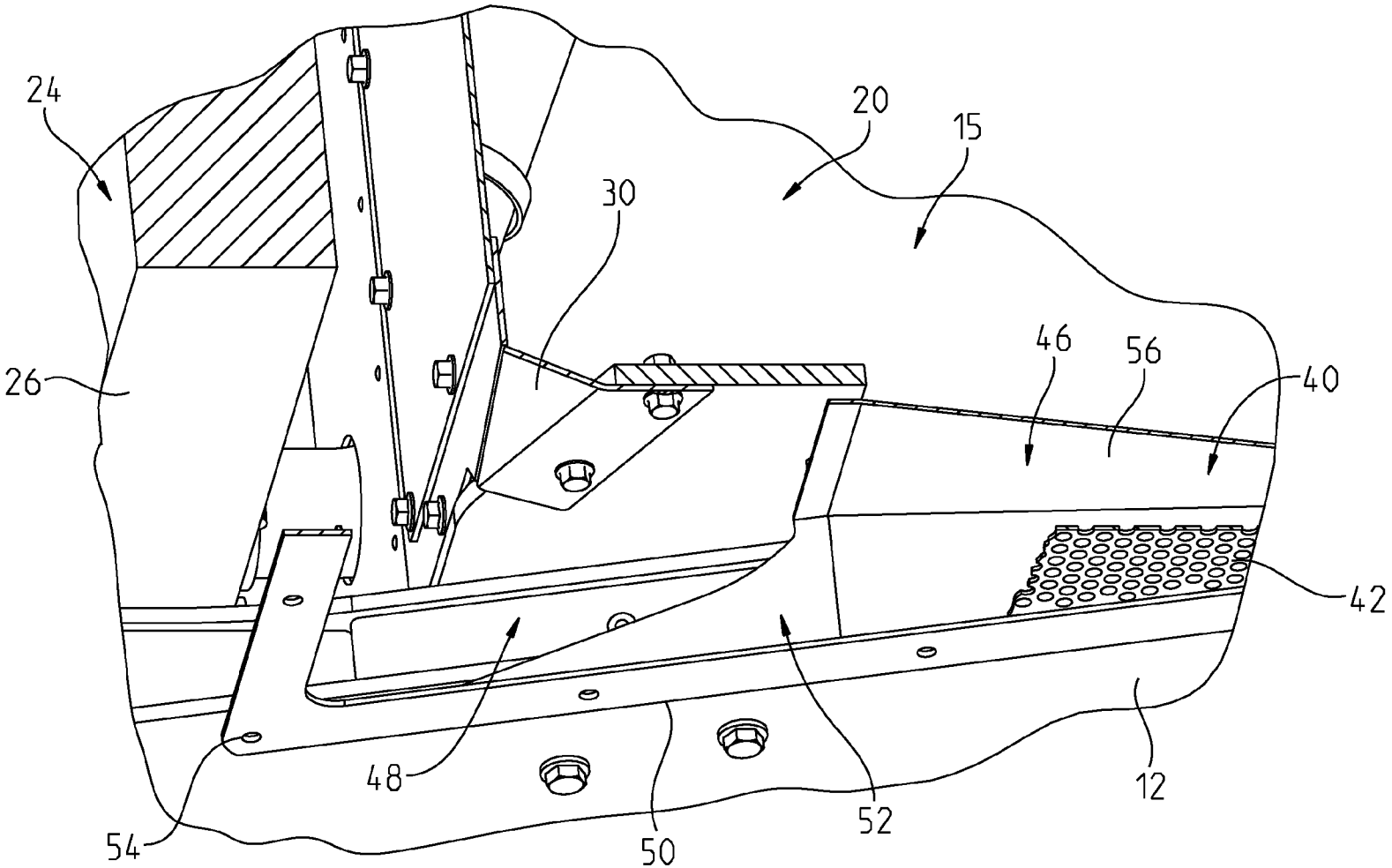
FIG. 5 is a perspective view of engine and cooling compartments of FIG. 2 with a horizontal cross sectional taken of the heat exchanger, the baffle and the side air intake.

As illustrated in FIGS. 3-5, side air intake baffle 56 is configured to engage compartment baffle 30. Side air intake baffle 56 may be coupled to or fastened to compartment baffle 30. Additional components may be utilized to engage side air intake baffle 56 with compartment baffle 30. Side air intake baffle 56 is also configured to engage vehicle frame 12. As best illustrated in FIG. 5, side air intake baffle 56 may be coupled to or fastened to vehicle frame 12. Alternatively, side air intake baffle 56 may closely align with or rest on vehicle frame 12. Additional components may be utilized to engage side air intake baffle 56 with compartment baffle 30.

In operation, side air intake baffle 56 is configured to inhibit preheating of ambient air used in cooling system 18. Side air intake baffle 56 inhibits air heated by engine 22 from mixing with ambient air used in cooling system 18.

As best illustrated in FIG. 4, air flow is shown according to an embodiment of the present disclosure. As shown, air flow services all parts of heat exchanger 26. Lower portion 58 of heat exchanger 26 is hidden behind vehicle frame 12. As illustrated, the larger surface area of cooler compartment portion 48 of side air opening 44 and side air intake 40 is configured to provide increased air flow service to Lower portion 58 of heat exchanger 26.

As best illustrated in FIG. 4, side air intake baffle 56 is shown to include rib 60 which is configured to abut notch 62 defined by compartment baffle 30. It is also envisioned that rib 60 is sized and positioned to overlap compartment baffle 30 in order to aid inhibiting air heated by engine 22 from mixing with ambient air used in cooling system 18 located in cooling compartment 24.

Figure 6:
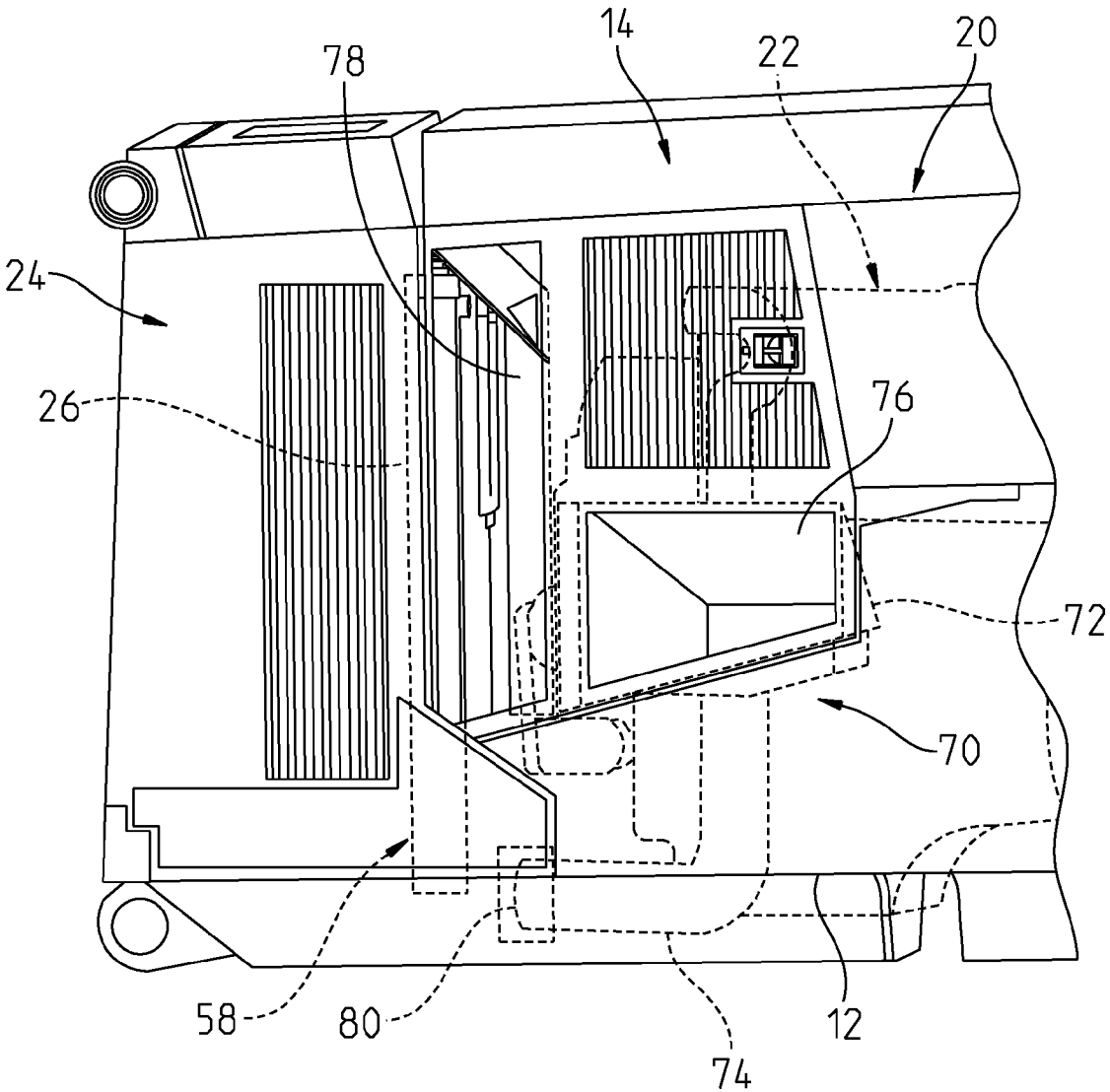
FIG. 6 is a perspective view of engine and cooling compartments according to another embodiment of the present disclosure configured for use with the vehicle of FIG. 1.

As illustrated in FIG. 6, an additional embodiment of the present disclosure is shown. In this exemplary embodiment, several components are the same or similar to previously disclosed components. Only new or significantly different components are discussed in detail.

Side air duct 70 is shown to include side air duct frame 72 and side air duct tubing 74. Side air duct frame 72 defines side air duct opening 76. Side air duct tubing 74 is coupled to side air duct frame 72. Side air duct 70 may include optional screen (not shown) designed to block dust, dirt, or similar debris from entering cooling compartment 24 and cooling system 18. The optional screen is also configured to allow ambient air to pass into cooling compartment 24 and cooling system 18. Cover 14 may also further define additional side air intake openings 78 located on cooling compartment 24 side of compartment baffle 30.

At least a portion of side air duct frame 72 is located within engine compartment 20. At least a portion of side air duct tubing 74 is also located within engine compartment 20. At least a portion of side air duct tubing 74 either terminates at or traverses through compartment baffle 30. Compartment baffle 30 may also define aperture 80 for side air duct tubing 74.

While this disclosure has been described as having an exemplary design, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

What is claimed is:

1. An air flow system for use with a vehicle including an internal combustion engine, a heat exchanger, a cover, wherein the cover defines an engine compartment for the engine and a cooling compartment for the heat exchanger, and a compartment baffle separating the engine compartment and the cooling compartment, the compartment baffle separating air heated by the engine from ambient air used with the heat exchanger, the air flow system comprising:

a fan located in the cooling compartment, the fan configured to draw ambient air over the heat exchanger, a side air intake configured to intake ambient air, the side air intake including a side air intake frame defining a side air intake opening, the side air intake including a screen located within the side air intake opening, the screen configured to inhibit debris from entering the cooling compartment, the side air intake including a side air intake baffle coupled to the side air intake frame, the side air intake baffle configured to inhibit air heated by the engine from mixing with ambient air used with the heat exchanger, wherein the side air intake is configured to provide ambient air to the lowest portion of the heat exchanger, the cover defining a side air opening, the side air opening being located along at least one side of the engine compartment, and the side air intake frame being located within the side air opening, the side air intake opening and the side air opening in fluid communication with ambient air and the cooling compartment.

2. The system of claim 1, wherein at least a portion of the heat exchanger is located lower than the lowest portion of the engine.

3. The system of claim 1, wherein the side air intake opening is located on the cover adjacent to the engine.

4. The system of claim 1, wherein the side air intake opening is located on the cover at the same height as the engine.

5. The system of claim 1, wherein at least a portion of the side air intake opening is located adjacent to the cooling compartment.

6. The system of claim 1, wherein at least a portion of the side air intake opening traverses the compartment baffle.

7. The system of claim 1, wherein the compartment baffle intersects the side air intake opening.

8. The system of claim 7, wherein the compartment baffle bisects the side air intake opening.

9. An air flow system for use with a vehicle including an internal combustion engine, a heat exchanger, a cover, wherein the cover defines an engine compartment for the engine and a cooling compartment for the heat exchanger, and a compartment baffle separating the engine compartment and the cooling compartment, the compartment baffle separating air heated by the engine from ambient air used with the heat exchanger, the air flow system comprising:

a fan located in the cooling compartment, the fan configured to draw ambient air over the heat exchanger, a side air intake configured to intake ambient air, the side air intake including a side air intake frame defining a side air intake opening, the side air intake including a screen located within the side air intake opening, the screen configured to inhibit debris from entering the cooling compartment, wherein the side air intake opening is located on the cover below the height of the engine, the side air intake including a side air intake baffle coupled to the side air intake frame, the side air intake baffle configured to inhibit air heated by the engine from mixing with ambient air used with the heat exchanger, and the side air intake frame being located within a side air opening defined by the cover, the side air intake opening and the side air opening in fluid communication with ambient air and the cooling compartment.

10. The system of claim 9, wherein the side air intake opening is adjacent to a frame portion of the vehicle.

11. The system of claim 10 wherein the side air intake is at least partially supported by the frame portion.

12. The system of claim 10 wherein the frame portion defines at least a portion of the engine compartment.

13. The system of claim 9, wherein a portion of the side air intake baffle couples to the compartment baffle.

14. The system of claim 13, wherein the side air intake baffle defines at least a portion of the engine compartment.

15. An air flow system for use with a vehicle including an internal combustion engine, a heat exchanger, a cover, wherein the cover defines an engine compartment for the engine and a cooling compartment for the heat exchanger, and a compartment baffle separating the engine compartment and the cooling compartment, the compartment baffle separating air heated by the engine from ambient air used with the heat exchanger, the air flow system comprising:

a fan located in the cooling compartment, the fan configured to draw ambient air over the heat exchanger, at least a portion of the heat exchanger being located lower than the lowest portion of the engine, a side air duct including a side air duct frame, the side air duct frame located within the engine compartment, the side air duct frame defining a side air duct opening, the side air duct including a screen located within the side air duct opening, the screen configured to inhibit debris from entering the cooling compartment, the side air duct including a side air duct tubing coupled to the side air duct frame, the side air duct tubing being at least partially located within the engine compartment, the side air duct tubing configured to inhibit air heated by the engine from mixing with ambient air used with the heat exchanger, wherein the side air duct tubing traverses the compartment baffle, and the side air duct being configured to intake ambient air, the side air duct opening and the side air duct tubing in fluid communication with ambient air and the cooling compartment.

16. The system of claim 15, wherein the compartment baffle defines an aperture for the side air duct tubing.

17. The system of claim 15, wherein the cover further defines an additional side air intake opening located on the side of the cooling compartment.

* * * * *